United States Patent [19]

Lubinsky et al.

[11] Patent Number: 4,537,494

[45] Date of Patent: Aug. 27, 1985

[54] MULTI-ROLL DEVELOPMENT SYSTEM

[75] Inventors: Anthony R. Lubinsky, Webster; Gary A. Denton, Rochester; Paul D. Keller, Rochester; James E. Williams, Rochester, all of N.Y.

[73] Assignee: Xerox Corporation, Stamford, Conn.

[21] Appl. No.: 574,114

[22] Filed: Jan. 26, 1984

[51] Int. Cl.[3] ..... G03G 15/08

[52] U.S. Cl. ..... 355/3 DD; 355/14 D; 355/3 BE; 355/16; 118/651

[58] Field of Search ..... 355/3 DD, 14 D, 16, 355/3 BE; 118/651, 661; 430/120

[56] References Cited

U.S. PATENT DOCUMENTS

| | | | |
|---|---|---|---|
| 4,350,432 | 9/1982 | Kondoh | 355/3 DD |
| 4,398,496 | 8/1983 | Kopko | 355/3 DD X |
| 4,410,260 | 10/1983 | Kuehnle | 355/3 BE X |
| 4,431,300 | 2/1984 | Snelling | 355/3 DD X |
| 4,466,730 | 8/1984 | Jugle | 355/3 DD |

*Primary Examiner*—A. C. Prescott

*Attorney, Agent, or Firm*—H. Fleischer; J. E. Beck; R. Zibelli

[57] ABSTRACT

An apparatus in which a plurality of developer rollers develop a latent image recorded on a flexible photoconductive member. The photoconductive belt is deflected by the developer material to wrap around at least a portion of the first two developer rollers forming wrapped development zones. The last developer roller may either have the photoconductive belt wrapped about a portion thereof, or the photoconductive belt may remain in an undeflected condition. The developer rollers having the photoconductive belt wrapped thereabout rotate in opposite directions. A blanket of developer material is formed between the last two developer rollers. An apparatus of this type optimizes development of the latent image recorded on the photoconductive member.

16 Claims, 4 Drawing Figures

MULTI-ROLL DEVELOPMENT SYSTEM

This invention relates generally to an electrostatographic printing machine, and more particularly concerns an apparatus for developing a latent image.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto.

The quality of the resultant image formed on the copy sheet is a function of the capabilities of the development system. Most commercial electrophotographic printing machines employ a magnetic brush development system for developing the latent image. The magnetic brush development system may employ one or more developer rollers for transporting the developer material closely adjacent to the photoconductive surface. The developer material may be conductive or insulating. In an insulating magnetic brush development system, the toner particles are deposited on the latent image, the brush of developer material accumulates a countercharge which, in turn, collapses the original electrical field responsible for development. This problem is overcome by increasing the speed and number of developer rollers transporting the developer material. In this way, a supply of fresh developer material is provided at a rapid rate, sufficient to achieve solid area development. Another approach induces a high mechanical shear between the brush of developer material and the photoconductive surface. This results in agitation of the developer material and physically transports the countercharge away from the latent image. A system of this type frequently is produced by having a low magnetic field in the development zone and extending the development zone. The development zone may be extended by wrapping it around a portion of the exterior circumferential surface of the developer roller.

It has been found that a conductive developer material optimumly develops solid areas while an insulating developer material optimumly develops lines in the latent image. To optimize development of both lines and solid areas, the apparatus should be capable of achieving the benefits of both insulating and conductive material. In this way, both solid areas and lines will be optimumly developed in the latent image. Hereinbefore, various systems have been devised for producing a development system which renders both the solid areas and lines optimumly developed. The following disclosure appears to be relevant:

Co-pending U.S. patent application Ser. No. 549,934 Applicant: Lubinsky Filed: Nov. 9, 1983.

The relevant portion of the foregoing disclosure may be briefly summarized as follows:

Lubinsky describes a development system employing two developer rollers. The first developer roller has a portion of the photoconductive belt wrapped about a portion of the exterior circumferential surface thereof. A low magnetic field is developed in the development zone. The second developer roller has the photoconductive belt spaced therefrom. In this way, the first developer roller optimumly develops solid areas with the second developer roller optimumly developing lines in the latent image. Furthermore, the second developer roller removes residual carrier granules adhering to the photoconductive member.

In accordance with one aspect of the features of the present invention, here is provided an apparatus for developing a latent image recorded on a flexible member with a developer material. The apparatus includes first means, positioned closely adjacent to the flexible member defining a first development zone therebetween, for transporting the developer material into contact with the flexible member in the first development zone. Second means, spaced from the first transporting means and positioned closely adjacent to the flexible member defining a second development zone therebetween, transports the developer material into contact with the flexible member in the second development zone. Means are provided for maintaining the flexible member, in the region of at least the first development zone and the second development zone, at a preselected tension of sufficient magnitude so that the developer material being transported into contact with the flexible member, in at least the first development zone and the second development zone, deflects the flexible member about the first transporting means and the second transporting means to form a wrapped first development zone and a wrapped second development zone. Third means, spaced from the second transporting means and positioned closely adjacent to the flexible member defining a third development zone therebetween, transports developer material into contact, in at least the third development zone, with the flexible member. The third transporting means receives developer material from the second transporting means forming a blanket of developer material therebetween. The first transporting means, second transporting means, and third transporting means transport developer material into contact with the latent images recorded on the flexible member to optimize development thereof.

Pursuant to another aspect of the present invention, there is provided an electrophotographic printing machine of the type having an electrostatic latent image recorded on a flexible photoconductive member. The printing machine includes first means, positioned closely adjacent to the photoconductive member defining a first development zone therebetween, for transporting the developer material into contact with the photoconductive member in the first development zone. Second means, spaced from the first transporting means and positioned closely adjacent to the photoconductive member defining a second development zone therebetween, transport the developer material into contact with the photoconductive member in the second development zone. Means are provided for maintaining the photoconductive member, in the region of at least the first development zone and the second development zone, at a preselected tension of sufficient magnitude so that the developer material being transported into contact with the photoconductive member, in at least the first development zone and the second development zone, deflects the photoconductive member about the first transporting means and the second transporting means to form a wrapped first development zone and a wrapped second development zone. Third means, spaced from the second transporting means and positioned closely adjacent to the photoconductive member defining a third development zone therebetween, transport developer material into contact, in at least the third development zone, with the photoconductive member. The third transporting means receives developer material from the second transporting means forming a blanket of developer material therebetween. The first transporting means, second transporting means and third transporting means transport developer material into contact with the latent image recorded on the photoconductive member to optimize development thereof.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
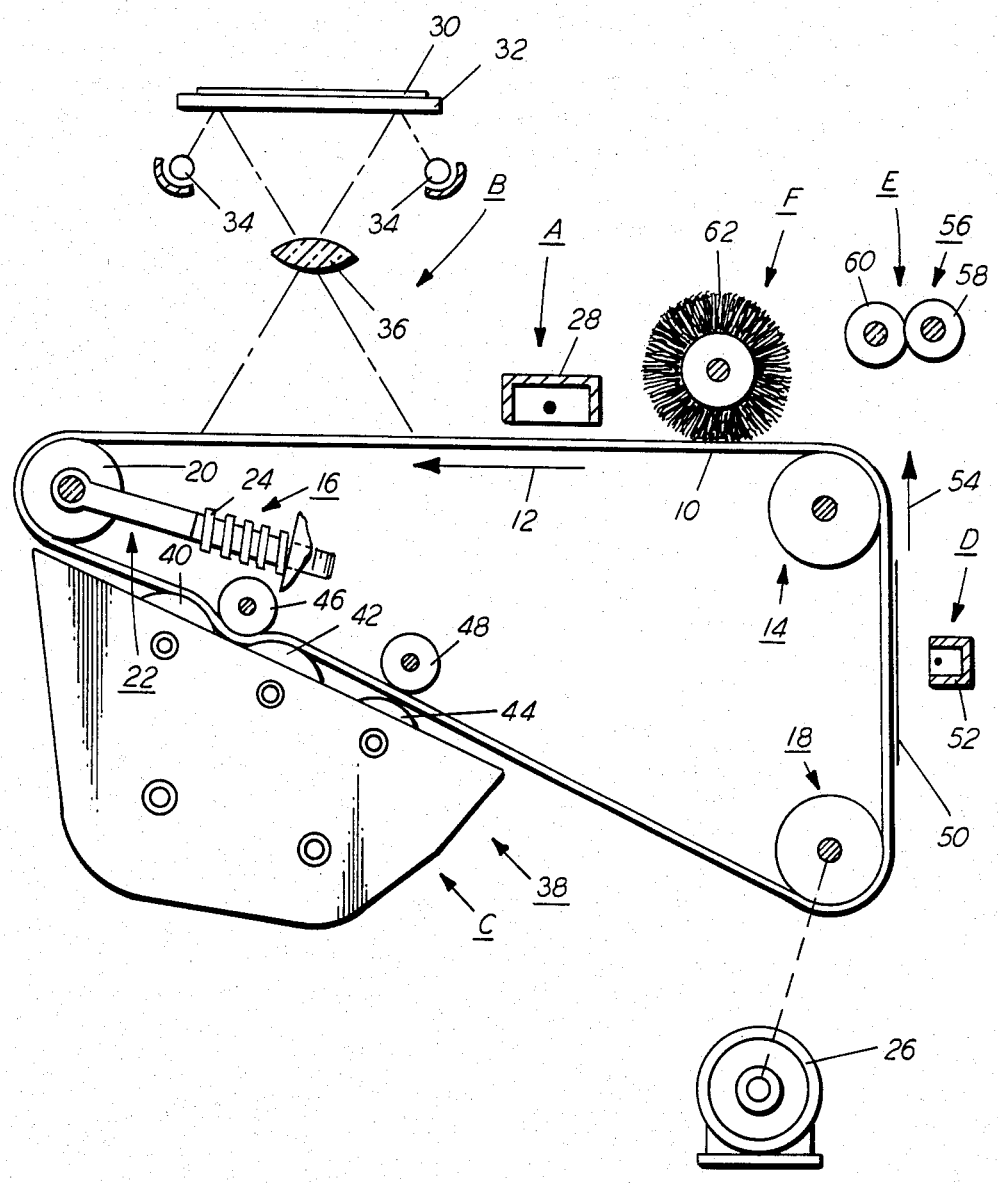
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. By way of example, the photoconductive surface includes a charge generating layer having photoconductive particles randomly dispersed in an electrically insulating organic resin. The conductive substrate comprises a charge transport layer having a transparent, electrically inactive polycarbonate resin with one or more diamines dissolved therein. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30. One skilled in the art will appreciate that a modulated beam of energy, e.g. a laser beam, may be employed to irradiate selected portions of the charged photoconductive surface to record the electrostatic latent image thereon. The beam of energy is modulated by electronic signals corresponding to information desired to be reproduced. Systems of this type may be employed in association with computer systems to print the desired information therefrom. After the electrostatic latent image is recorded on the photoconductive surface, belt 10 advances the electrostatic latent image to development station C.

At development station C, a magnetic brush development system, indicated generally by the reference numeral 38, advances the developer material into contact with the electrostatic latent image. Magnetic brush development system 38 includes a developer roller 40 which transports a brush of developer material comprising carrier granules and magnetic toner particles into contact with belt 10. As shown in FIG. 1, developer roller 40 is positioned such that the brush of developer material deflects belt 10 to define a wrapped development zone. The electrostatic latent image attracts the toner particles from the carrier granules forming a toner powder image on the photoconductive surface of belt 10. Developer roller 42 is spaced from developer roller 40. Similarly, developer roller 42 transports a brush of developer material into contact with belt 10. Developer roller 42 is positioned such that the brush of developer material deflects belt 10 thereabout to define a wrapped development zone. Once again, the electrostatic latent image attracts the toner particles from the carrier granules further enhancing development of the latent image recorded on the photoconductive surface with toner particles. Finally, developer roller 44 is spaced from developer roller 42 and, in turn, from belt 10. Developer roller 44 transports the developer material into contact with the latent image to further develop the latent image and to scavenge or remove residual carrier granules adhering to belt 10. Idler rollers 46 and 48 aid in deflecting belt 10 around the respective developer rollers 40 and 42 to form development zones which wrap thereabout. Idler roller 46 is positioned between developer rollers 40 and 42. Idler roller 48 is positioned opposed from developer roller 44. A portion of the photoconductive belt passing between idler roller 48 and developer roller 44 remain substantially flat and undeflected. The foregoing generally describes one embodiment of development system 38. The detailed structure of this embodiment will be described hereinafter with reference to FIG. 3. An alternate embodiment of development system 38 will be described in detail with reference to FIG. 4.

With continued reference to FIG. 1, after development, belt 10 advances the toner powder image to transfer station D. At transfer station D, a sheet of support material 50 is moved into contact with the toner powder image. Sheet 50 is advanced to transfer station D by a sheet feeding apparatus (not shown). By way of example, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 52 which sprays ions onto the back side of sheet 50. This attracts the toner powder image from the photoconductive surface to sheet 50. After transfer, sheet 50 moves in the direction of arrow 54 onto a conveyor (not shown) which advances sheet 50 to fusing station E.

Fusing station E includes a fuser assembly, indicated generally by the reference numeral 56, which permanently affixes the toner powder image to sheet 50. Preferably, fuser assembly 56 includes a back-up roll 58 and a heated fuser roll 60. Sheet 50 passes beneath fuser roller 60 and back-up roller 58 with the toner powder image contacting fuser roller 60. In this manner, the toner powder image is permanently affixed to sheet 50. After fusing, a chute (not shown) guides the advancing sheet to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. By way of example, cleaning station F may include a rotatably mounted fibrous brush 62 in contact with the photoconductive surface. The particles are cleaned from the photoconductive surface by the rotation of brush 62. Subsequent to cleaning, a discharge lamp (not shown) floods the photoconductive surface with light to dissipate any residual electrostatic charge remaining thereon prior to the charging thereof for the next successive imaging cycle.

Figure 2:
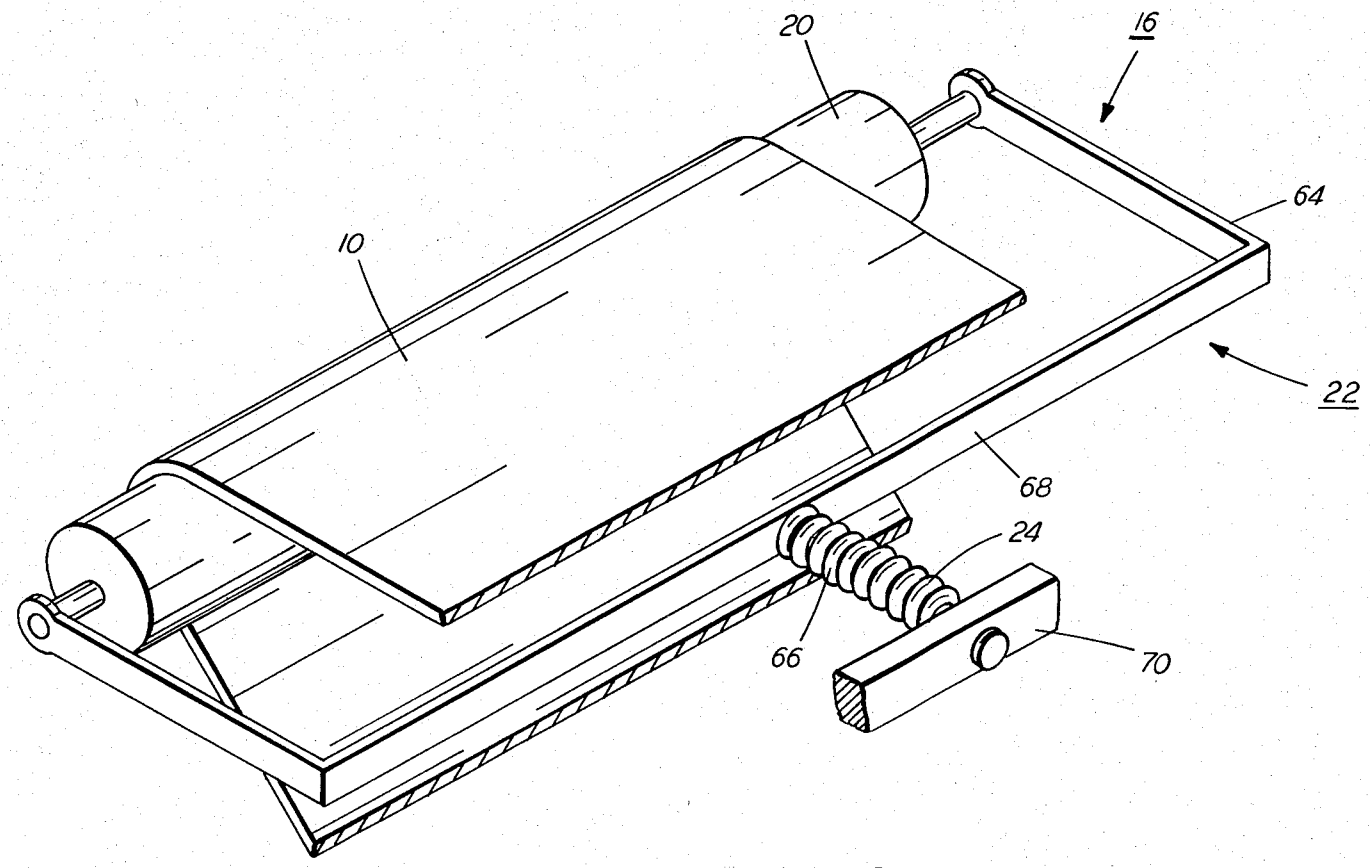
FIG. 2 is a fragmentary, perspective view showing the belt tensioning arrangement for the FIG. 1 printing machine.

Referring now to FIG. 2, tensioning system 16 is depicted thereat in greater detail. As shown, tensioning system 16 includes roller 20 having belt 10 passing thereover. Roller 20 is mounted in suitable bearings in a yoke, indicated generally by the reference numeral 22. Preferably, yoke 22 includes a U-shaped member 64 supporting roller 20 and a rod 66 secured to the midpoint of cross member 68 of U-shaped member 64. A coil spring 24 is wrapped around rod 66. Rod 66 is mounted slidably in the printing machine frame 70. Coil spring 24 is compressed between cross member 68 and frame 70. Compressed spring 24 resiliently urges yoke 22 and, in turn, roller 20 to press against belt 10. Spring 24 is designed to have the appropriate spring constant so that when placed under the desired compression, belt 10 is tensioned to about 1 Newton/centimeter. Belt 10 is maintained under a sufficiently low tension to enable the developer material on developer rollers 40 and 42 to deflect belt 10 about developer rollers 40 and 42 through an arc ranging from about 5° to about 25° defining wrapped development zones about developer roller 40 and developer roller 42.

It is believed that the foregoing description is sufficient for purposes of the present application to illustrate the general operation of the illustrative electrophotographic printing machine incorporating the features of the present invention therein.

Figure 3:
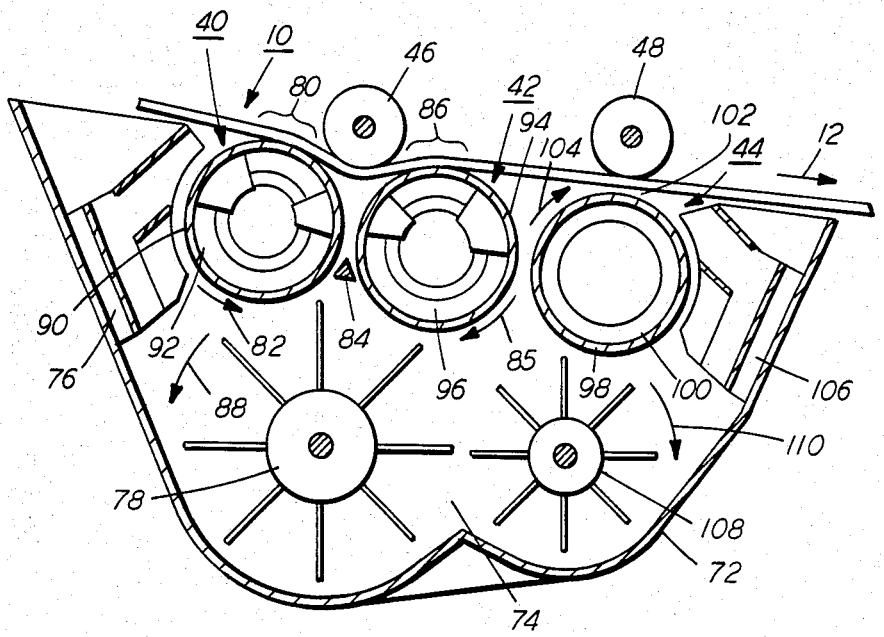
FIG. 3 is an elevational view illustrating one embodiment of the development system used in the FIG. 1 printing machine.

Turning now to the specific subject matter of the present invention, FIG. 3 depicts the detailed structure of one embodiment of development system 38. The embodiment depicted in FIG. 3 is shown broadly in FIG. 1. As shown in FIG. 3, development system 38 includes a housing 72 defining a chamber 74 for storing a supply of developer material therein. A passive cross-mixer 76 receives fresh toner particles from a toner dispenser (not shown) and inermixes these toner particles with developer material released from developer roller 40. A cylindrical member 78 having a plurality of vanes extending outwardly therefrom mixes and transports the developer material into a region closely adjacent to developer roller 40. In this region, the developer material is attracted to developer roller 40 to be advanced into development zone 80. Developer roller 40 advances the developer material in the direction of arrow 82. Metering blade 84 splits the flow of developer material from member 78 between developer rollers 40 and 42. Developer roller 42 advances the developer material in the direction of arrow 85 into development zone 86. As shown, member 78 rotates in the direction of arrow 88 to transport the developer material from chamber 74 to developer rollers 40 and 42. Metering blade 84 splits the flow of developer material substantially equally between developer rollers 40 and 42. Alternatively, the developer material flow may be split magnetically by the design of the respective magnets of developer rollers 40 and 42. Idler roller 46 is positioned such that belt 10 wraps around developer roller 40 and developer roller 42 forming extended wrapped development zones 80 and 86. Developer roller 40 includes a non-magnetic tubular member 90, made preferably from aluminum, having the exterior circumferential surface thereof roughened. An elongated magnet 92 is positioned interiorly of and spaced from tubular member 90. Preferably, magnet 92 is mounted stationarily and generates a low magnetic field in development zone 80 to permit high agitation of the developer material thereat. As shown, the tangential velocity of developer roller 40 in development zone 80 is opposed to the direction of movement of belt 10, as indicated by arrow 12. Similarly, developer roller 42 includes a tubular member 94, made preferably from aluminum, having the exterior circumferential surface thereof roughened. An elongated magnetic member 96 is positioned concentrically within tubular member 94 and spaced from the interior circumferential surface thereof. Magnetic member 96 is mounted stationary. The magnetic field produced by magnet 96 is low in development zone 86 to promote agitation of the developer material therein. The developer material, in the region between developer rollers 40 and 42, is split magnetically by the design of the magnetic poles on magnets 92 and 96. In this way, approximately half of the developer material remains with developer roller 42 with the other half being transferred to developer roller 40. Alternatively, a metering blade may be used to split the flow of developer material. The tangential velocity of tubular member 94, in development 86, is in the same direction as the velocity of belt 10, as indicated by arrow 12. Tubular member 90 and tubular member 94 are both electrically biased by voltage sources (not shown) to a suitable polarity and magnitude. The voltage level is intermediate that of the background voltage level and the image voltage level recorded on the photoconductive surface of belt. By way of example, tubular member 90 and tubular member 94 may be electrically biased to different voltage levels ranging from about 50 volts to about 350 volts. The developer material adhering to developer roller 42 is transported to developer roller 44. A blanket of developer material forms between developer roller 42 and developer roller 44. Developer roller 44 includes a tubular member 98, made preferably from aluminum, having the exterior circumferential surface thereof roughened. An elongated magnetic member 100 is positioned concentrically within tubular member 98 and spaced from the interior circumferential surface thereof. Preferably, magnet 100 is mounted stationary. Tubular member 98 is spaced from belt 10. Idler roller 48 is positioned opposed from tubular member 98 providing a support for belt 10 such that belt 10 remains substantially flat as it passes through the development zone 102. Tubular member 98 rotates in the direction of arrow 104. Thus, the developer material passing into development zone 102 moves in the same direction as that of belt 10, as indicated by arrow 12. Magnet 100 forms a relatively strong magnetic field in development zone 102. Tubular member 98 is electrically biased by a voltage source (not shown) to a suitable polarity and magnitude. Once again, the voltage level is intermediate that of the background voltage level and the image voltage level recorded on the photoconductive surface of belt 10. By way of example, the voltage source electrically biasing tubular member 98 may bias it to a voltage ranging from about 50 volts to about 350 volts. Developer material released from developer roller 44 passes into a passive crossmixer 106. The residual developer material is mixed and passes into the chamber 74 of housing 72 where a cylindrical member 108 having a plurality of vanes extending outwardly therefrom transports the residual developer material and new developer material to cylindrical member 78. Cylindrical member 106 rotates in the direction of arrow 110.

Bidirectional development is produced by developer rollers 40 and 42 and results in excellent copy quality. The differences in development between the leading and trailing edges of large solid areas observed with unidirectional systems is reduced or eliminated. The first two developer rollers, i.e. developer roller 40 and developer roller 42, produce excellent solid area and halftones with low background. This is accomplished even at relatively high process speeds, i.e. wherein belt 10 moves from 10 to 25 inches per second. Inasmuch as the developer material establishes the spacing between belt 10 and the respective developer roller, i.e. developer roller 40 or 42, there is no requirement to maintain close mechanical tolerances in order to define the appropriate spacings in the respective development zones 80 and 86. Developer roller 42 and developer roller 44 both transport the developer material in the same direction, in the development zone, as the direction of movement of belt 10. This results in a less scratchy and noisy image compared to the case wherein the last developer roller rotates such that the developer material moves in a direction opposed to the direction of movement of the photoconductive belt. Furthermore, developer roller 44 produces a fringe field type of development. Thus, developer roller 44 optimizes development of lines within the electrostatic latent image. It is thus seen that the system utilizes particular developer rollers to optimize development of the solid areas within the latent image and the lines contained therein. Finally, developer roller 44 will also scavenge or remove residual carrier particles adhering to photoconductive belt 10.

Figure 4:
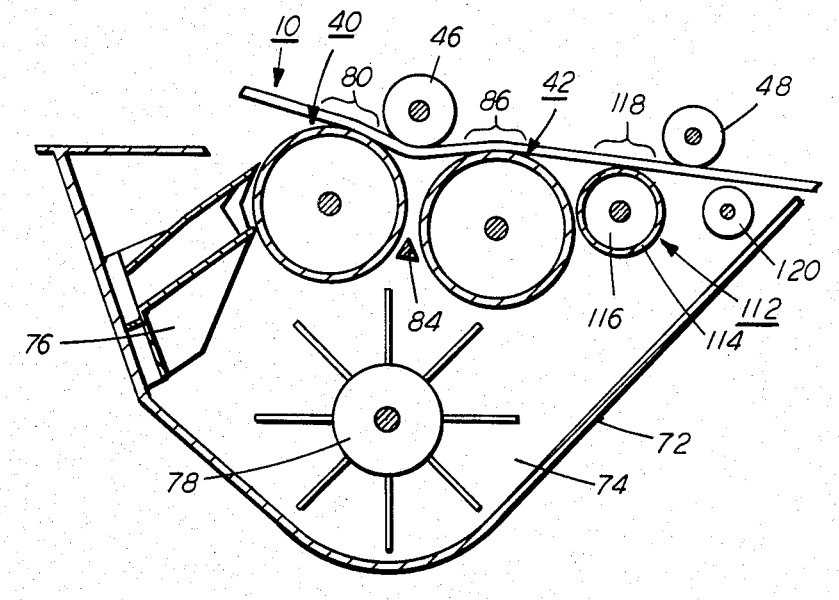
FIG. 4 is an elevational view illustrating another embodiment of the development system used in the FIG. 1 printing machine.

Turning now to FIG. 4, there is shown another embodiment of development system 38. In this embodiment, cylindrical member 78 having vanes extending outwardly therefrom is positioned in chamber 74 of housing 72. Additional toner particles may be added to chamber 74 of housing 72 by passing through a passive crossmixer 76. As cylindrical member 78 rotates, it transports developer material to developer rollers 40 and 42 as hereinbefore described with reference to the embodiment depicted in FIG. 3. Idler roller 46 is interposed between developer rollers 40 and 42 such that an extended development zone is formed about each of the respective developer rollers. The developer material is split between developer rollers 40 and 42. The third developer roller, i.e. developer roller 112, is spaced from developer roller 42. Developer roller 112 has a tubular member 114, made preferably from aluminum, having the exterior circumferential surface thereof roughened. Tubular member 114 is of a smaller diameter then tubular members 90 and 94 of developer rollers 40 and 42, respectively. An elongated magnet 116 is positioned concentrically within tubular member 114. Preferably, magnetic member 116 is mounted stationarily and produces a low magnetic field in development zone 118. Idler roller 48 is positioned between developer roller 112 and idler roller 120. Developer roller 112 is positioned such that belt 10 wraps about a portion of the exterior circumferential surface thereof forming an extended development zone 118. Thus, it is seen that in the embodiment depicted in FIG. 4, the development system comprises three developer rollers, each of which have an extended or wrapped development zone. Belt 10 wraps around developer roller 112 in development zone 118 through an arc ranging from about 5° to about 25°. The arc that belt 10 wraps about developer roller 112 is less than the arc belt 10 wraps about developer rollers 40 and 42. The distinction between the embodiment depicted in FIG. 4 and that of FIG. 3 is that the last developer roller, i.e. developer roller 112, has a wrapped development zone 118 whereas developer roller 44 (FIG. 3) is not a wrapped development zone 102. The loss of the spaced developer roller results in some loss in fine line development, but the utilization of a wrapped development zone results in an improvement in background suppression. Developer material is transported from developer roller 42 to developer roller 112. The developer material forms a blanket of developer material in the zone therebetween. Tubular member 114 rotates in a direction such that the developer material adhering thereto advances in development zone 118 in the same direction as the movement of photoconductive belt 10. A voltage source is provided for electrically biasing tubular member 114 to a suitable polarity and magnitude. The voltage level is intermediate that of the background voltage level and image voltage level recorded on the photoconductive surface of belt 10. By way of example, the voltage source electrically biases tubular member 114 to a voltage ranging from about 50 volts to about 350 volts. The electrical bias applied to tubular member 114 does not necessarily have to be of the same magnitude as the electrical bias applied to the respective tubular members of developer rollers 40 and 42. Developer roller 112 removes any copy quality defects generated by developer rollers 40 and 42. These defects appear to occur primarily at higher process speeds in the wrapped development zone. A small wrap about developer roller 112 and its smaller diameter reduces the period of contact with belt 10.

By way of example, the developer material stored in chamber 74 of housing 72 comprises magnetic toner particles and carrier granules. The developer material has a conductivity equal to or less than $10^{-14}$ (ohm-cm)$^{-1}$.

The development system of the present invention efficiently utilizes three developer rollers. The first two developer rollers optimize development of solid areas in the electrostatic latent image with the other developer roller, in one embodiment, optimizing development of low density lines and halftones in the electrostatic latent image. In the other embodiment, all three developer rollers are utilized to optimize solid area development. However, it has been found that, in this latter embodiment, sufficient line development is produced to render a high quality copy. Hence, the various embodiments of the development system of the present invention significantly improve development of a latent image recorded on a photoconductive surface in an electrophotographic printing machine. This development system results in significantly higher quality copies than have hereinbefore been attainable.

It is, therefore, evident that there has been provided in accordance with the present invention various embodiments of an apparatus for developing an electrostatic latent image that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An apparatus for developing a latent image recorded on a flexible member with a developer material, including:

first means, positioned closely adjacent to the flexible member defining a first development zone therebetween, for transporting the developer material into contact with the flexible member in the first development zone;

second means, spaced from said first transporting means and positioned closely adjacent to the flexible member defining a second development zone therebetween, for transporting the developer material into contact with the flexible member in the second development zone;

means for maintaining the flexible member, in the region of at least the first development zone and the second development zone, at a preselected tension of sufficient magnitude so that the developer material being transported into contact with the flexible member, in at least the first development zone and the second development zone, deflects the flexible member about said first transporting means and said second transporting means to form a wrapped first development zone and a wrapped second development zone; and third means, spaced from said second transporting means and positioned closely adjacent to the flexible member defining a third development zone therebetween, for transporting developer material into contact, in at least the third development zone, with the flexible member, said third transporting means receiving developer material from said second transporting means forming a blanket of developer material therebetween, said first transporting means, said second transporting means and said third transporting means transporting developer material into contact with the latent image recorded on the flexible member to optimize development thereof.

2. An apparatus according to claim 1, wherein said maintaining means maintains the flexible member, in the region of the third development zone, at a preselected tension of sufficient magnitude so that the developer material being transported into contact with the flexible member deflects the flexible member about said third transporting means to form a wrapped third development zone.

3. An apparatus according to claim 1, wherein said maintaining means maintains the flexible member, in the region of the third development zone at a preselected tension of sufficient magnitude so that the flexible member remains undeflected in the third development zone.

4. An apparatus according to claims 2 or 3, wherein the flexible member is a belt.

5. An apparatus according to claim 4, wherein said first transporting means includes:

a first tubular member journaled for rotary movement; and a first magnetic member disposed interiorly of and spaced from said first tubular member to attract the developer material thereto.

6. An apparatus according to claim 5, wherein said second transporting means includes:

a second tubular member journaled for rotary movement, said second tubular member rotating in a direction opposite to the direction of rotation of said first tubular member; and a second magnetic member disposed interiorly of and spaced from said second tubular member to attract the developer material thereto.

7. An apparatus according to claim 6, wherein said third transporting means includes:

a third tubular member journaled for rotary movement, said third tubular member rotating in the same direction as the direction of rotation of said second tubular member; and a third magnetic member disposed interiorly of and spaced from said third tubular member to attract the developer material thereto.

8. An apparatus according to claim 7, wherein said belt moves in the opposite direction as the direction of the tangential velocity of said first tubular member in the first development zone.

9. An electrophotographic printing machine of the type having an electrostatic latent image recorded on a flexible photoconductive member, wherein the improvement includes:

first means, positioned closely adjacent to the photoconductive member defining a first development zone therebetween, for transporting the developer material into contact with the photoconductive member in the first development zone;

second means, spaced from said first transporting means and positioned closely adjacent to the photoconductive member defining a second development zone therebetween, for transporting the developer material into contact with the photoconductive member in the second development zone;

means for maintaining the photoconductive member, in the region of at least the first development zone and the second development zone, at a preselected tension of sufficient magnitude so that the developer material being transported into contact with the photoconductive member, in at least the first development zone and the second development zone, deflects the photoconductive member about said first transporting means and said second transporting means to form a wrapped first development zone and a wrapped second development zone; and third means, spaced from said second transporting means and positioned closely adjacent to the photoconductive member defining a third development zone therebetween, for transporting developer material into contact, in at least the third development zone, with the photoconductive member, said third transporting means receiving developer material from said second transporting means forming a blanket of developer material therebetween, said first transporting means, said second transporting means and said third transporting means transporting developer material into contact with the latent image recorded on the photoconductive member to optimize development thereof.

10. A printing machine according to claim 9, wherein said maintaining means maintains the photoconductive member, in the region of the third development zone, at a preselected tension of sufficient magnitude so that the developer material being transported into contact with the photoconductive member deflects the photoconductive member about said third transporting means to form a wrapped third development zone.

11. A printing machine according to claim 10, wherein said maintaining means maintains the photoconductive member, in the region of the third development zone at a preselected tension of sufficient magnitude so that the photoconductive member remains undeflected in the third development zone.

12. A printing machine according to claims 10 or 11, wherein the photoconductive member is a belt.

13. A printing machine according to claim 12, wherein said first transporting means includes:

a first tubular member journaled for rotary movement; and a first magnetic member disposed interiorly of and spaced from said first tubular member to attract the developer material thereto.

14. A printing machine according to claim 13, wherein said second transporting means includes:

a second tubular member journaled for rotary movement, said second tubular member rotating in a direction opposite to the direction of rotation of said first tubular member; and a second magnetic member disposed interiorly of and spaced from said second tubular member to attract the developer material thereto.

15. A printing machine according to claim 14, wherein said third transporting means includes:

a third tubular member journaled for rotary movement, said third tubular member rotating in the same direction as the direction of rotation of said second tubular member; and a third magnetic member disposed interiorly of and spaced from said third tubular member to attract the developer material thereto.

16. A printing machine according to claim 14, wherein said belt moves in the opposite direction as the direction of the tangential velocity of said first tubular member in the first development zone.

* * * * *